US006850171B2

(12) United States Patent
Mathias

(10) Patent No.: US 6,850,171 B2
(45) Date of Patent: Feb. 1, 2005

(54) METHOD, SYSTEM AND CONTROL DEVICE FOR CONTROLLING LIGHT SIGNAL TRANSMITTERS AT INTERSECTIONS

(75) Inventor: Paul Mathias, Aachen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/247,549

(22) Filed: Sep. 20, 2002

(65) Prior Publication Data

US 2003/0063016 A1 Apr. 3, 2003

(30) Foreign Application Priority Data

Sep. 20, 2001 (DE) ..... 101 46 398

(51) Int. Cl.[7] ..... G08G 1/07

(52) U.S. Cl. ..... 340/907; 340/917; 701/118; 701/119

(58) Field of Search ..... 340/907, 909, 340/916, 917, 920; 701/118, 119; 116/63 R

(56) References Cited

U.S. PATENT DOCUMENTS 3,818,429 A * 6/1974 Meyer et al. ..... 340/910
5,509,082 A * 4/1996 Toyama et al. ..... 382/104

FOREIGN PATENT DOCUMENTS

| | | |
|---|---|---|
| DE | 2 207 487 | 9/1973 |
| DE | 41 06 024 C1 | 4/1992 |
| DE | 4436339 | 4/1996 |

OTHER PUBLICATIONS

Alexander Bogomolny, In a Few Words . . . , Website www.cut–the–knot.org/do_you_know/few_words.shtml, copyright 1996–2004, definition of "space" and "distance".*
Merriam–Webster's Collegiate Dictionary, Tenth Edition, 2001, the term "distance".*

* cited by examiner

*Primary Examiner*—Jeffery Hofsass
*Assistant Examiner*—Jennifer Stone
(74) *Attorney, Agent, or Firm*—Harness, Dickey & Pierce, P.L.C.

(57) ABSTRACT

A system and method for providing local intersection control includes controlling light signal transmitters at an intersection. A traffic condition at an intersection is cyclically detected, a signal program is selected that is matched to the detected traffic condition, and the selected signal program issues switching commands to the light signal transmitter. Characteristic traffic conditions are derived from the detected traffic conditions for the intersection, each characteristic traffic condition is assigned a signal program matched to this traffic condition, a metric is defined as measure for positions of two traffic conditions relative to each other, the characteristic traffic condition that is closest to the actual traffic condition with respect to the metric is determined, and the signal program assigned to the closest characteristic traffic condition is executed for triggering switching commands for the light-signal transmitters. A control device is also included for realizing the method. This system has a higher flexibility during changes in the traffic conditions than purely fixed-time controls and a higher capacity with minimum planning and supply expenditure and a moderate number of detectors.

22 Claims, 2 Drawing Sheets

METHOD, SYSTEM AND CONTROL DEVICE FOR CONTROLLING LIGHT SIGNAL TRANSMITTERS AT INTERSECTIONS

The present application hereby claims priority under 35 U.S.C. §119 on German patent publication number 10146398.7 filed Sep. 20, 2001, the entire contents of which are hereby incorporated herein by reference.

FIELD OF THE INVENTION

The invention generally relates to a method for controlling light signal transmitters at a junction, such as traffic light signal transmitters for example. Additionally, it generally relates to a system and control device for realizing such a method.

BACKGROUND OF THE INVENTION

The traffic at street intersections, so-called road junctions, is nowadays primarily controlled with light signal systems. A light signal system includes a combination of light signal transmitters for various roads approaching the intersection and the required operating devices for controlling the traffic flow. A light signal transmitter in that sense may be a transmitting apparatus that transmits visible signals to the traffic participants. A signal program runs in a local control device for the intersection, in which the signal times for the light signal system are fixed with respect to duration and assignment. For this, a distinction is made between fixed time controlled and traffic-dependent methods for controlling the signal transmitters at an intersection.

The fixed time signal control is a light-signal control with fixed signal times, without an influencing option for the traffic participant. This macroscopic signal control is based on taking into account the long-term traffic situation at the intersection. The method uses signal programs, operating on the basis of fixed-time tables, with a rigid sequence of automatic operations for the days and weeks. The switching moments for changing the signal program at individual junctions with fixed time control, for example, are therefore adjusted for the respective day of the week. The method is simple per se since it does not require detectors for the continuous detection of the traffic situation at the intersection. Fixed-time controlled methods are relatively cost-effective, to be sure, because of the average planning expenditure, but are not flexible over the short run or the long run with respect to changes in the traffic conditions at the intersection. Additional planning is therefore always required.

These methods are contrasted by the traffic-dependent methods where the signal control is microscopic, meaning it is realized by taking into account the short-term traffic situation at the intersection. The light signal system of a partially traffic dependent method is controlled by time intervals recorded in a signal plan, with switching of the green times and/or release times of a few individual signal groups depending on individually arriving traffic participants. In contrast, the fully traffic dependent method adjusts all release times for a light signal system at an intersection by sensing the arrival of individual traffic participants. These complex methods, for example the phase control with decentralized modification, frame phase plans or flow charts require an involved automatic detection of traffic conditions or changes in the conditions. Frequently they require several detectors, such as induction loops, infrared sensors or radar detectors for each approach to the intersection. As a result, these control methods are very flexible in the short term, but have only an average flexibility for the long term, so that additional planning becomes necessary. On the whole, these traffic-dependent methods are cost-intensive and require a great deal of planning.

German Patent 44 36 339 A1 discloses a method for the traffic-adaptive control of a traffic light system, which processes data provided by sensors for detecting the traffic in the area of the intersection. The method does not use predetermined models or algorithms in addition to the principles necessary for traffic safety, but learns the most favorable methods for controlling the traffic flow for all typical traffic situations at intersections, stores these data and uses the data for adapting the green phases to the traffic flow in dependence on the time fluctuations of the traffic occurrence.

A so-called feed-forward net is selected for the control, by means of which the reinforcement learning is trained. The signals obtained from the sensor data are transmitted to the net inputs. Thus, they are available at the net outputs in processed form for triggering the signal groups during a decision cycle in which each neuron of the net determines its output value from its input provided with synapses. The traffic flow resulting from the signal groups switched in this way is evaluated by computing a real number. This real number is the higher the more vehicles pass the intersection and the fewer vehicles wait at the stop line. During one learning cycle, this real number is subsequently converted into suitable place value changes for the weights in the synapses, so that following many sequences of decision cycles and learning cycles, the real number adjusts to the highest possible value that corresponds to the most favorable traffic flow control. The time is required for the pre-training of the neuronal net increases the more complicated the traffic intersection becomes. In order to increase the learning speed, additional sensors are required at specific distances before the stop line in addition the respectively one sensor at the stop line.

U.S. Pat. No. 3,818,429 discloses a traffic guidance system, consisting of a control method and a control device for selecting a specific program for controlling light signal transmitters at one or several consecutive intersections from a plurality of programs stored ahead of time on punched tapes. The control device for the traffic guidance system is connected to devices installed at intersections for controlling the light-signal transmitters, as well as to vehicle detectors for detecting the traffic conditions at the respective intersections. The optimum program is selected in cycles with the aid of an electronic computation and analysis of the actual traffic conditions. For this, averaged values for the different dynamic traffic parameters, such as density, speed and volume of the traffic, are computed from signals emitted by the vehicle detectors. Differences in the traffic volume are assigned to specific, predetermined ranges of the traffic parameters and it is determined in which parameter range the actual traffic volume is located. A program can also be selected on the basis of time of day and day of the week through a specific programming of the control device. A program in this case is understood to mean a data block of time intervals that determine the switching moments for the light-signal transmitters during a cycle. If the actual parameter range is exceeded during a running cycle, a new program that is matched to the actual traffic conditions is activated during the following cycle.

One problem is that in addition to the aforementioned disadvantages, the known controls require a considerable supply and testing expenditure on the part of the traffic planner and/or operator. Further, subsequent planning is necessary, frequently based on fundamental changes in the traffic conditions during the course of months or years.

SUMMARY OF THE INVENTION

Thus, an object of an embodiment of the invention is to provide a system and method for local intersection control, having a higher flexibility for changes in the traffic conditions than is the case with fixed-time controls. At the same time, the system should have a high capacity with little planning and supply expenditure, and should require a moderate number of detectors.

The planning and supply expenditure may be limited to the input of basic data such as intersection topology, main directions, signal group definition, minimum green times and transitions times, intermediate times and set-up lengths and a few frame conditions such as priorities and optimization criteria by using a method of one embodiment for deriving characteristic traffic conditions for the intersection. According to one embodiment, this is done by assigning a signal program to each characteristic traffic condition, matched to this condition, by defining a metrics as measure for the position of two traffic conditions relative to each other, by determining the characteristic traffic condition that is closest to the actual traffic condition with respect to the defined metrics, and by realizing the signal program closest to the characteristic traffic condition for issuing switching commands for the light-signal transmitters. With the aid of the automatic selection of a signal program that is matched to the actual traffic situation, the method can adapt over a short time scale to changing traffic conditions. As a result, the method according to an embodiment of the invention has a clearly higher flexibility than fixed-time controlled methods, that is to say with a relatively simple detection of traffic conditions in the form of simple counting values. In addition, the traffic-technical expenditure is reduced since the method according to an embodiment of the invention adapts automatically to changing frame conditions.

The wide variety of traffic conditions occurring at an intersection may be classified based on the frequency of occurrence and the spatial distribution of all traffic conditions by forming a static distribution of all detected traffic conditions after each detection of the actual traffic condition, by combining the traffic conditions into classes according to the statistical distribution and by determining for each class of traffic conditions a characteristic traffic condition as representative of the class. With the aid of the metrics as measure for the positions of two traffic conditions relative to each other, a characteristic traffic condition can be computed within a class of traffic conditions, for example a main focal point or cluster point. As a result of this clustering, the multitude of traffic conditions occurring at an intersection is narrowed down to a limited number of typically occurring traffic conditions that make sense, the characteristic traffic conditions. In turn, this reduces the number of signal programs matched to the characteristic traffic conditions, which must be stored.

According to one advantageous embodiment of the method according to the invention, the distance between a newly determined characteristic traffic condition of one class of traffic conditions and the actually valid characteristic traffic condition for this class is determined if, upon exceeding a predetermined threshold value for the distance, the actually valid characteristic traffic condition replaces the newly determined characteristic traffic condition for this class and computes a signal program that is assigned to the newly determined, characteristic traffic condition for this class. As a result, time fluctuations in the statistical distribution of traffic conditions are taken into account, which are accompanied by a movement or drifting of the characteristic traffic conditions. If the characteristic traffic condition of a class drifts off too far, a new characteristic traffic condition is determined for this class and a signal program matched to this traffic condition is determined. As a result, a method is available that adapts to changing traffic conditions on an average to long-term time scale. Owing to the integrated signal program computation, a highly flexible control and performance capacity that does not age is obtained since an optimally matched set of signal programs is always available.

For one preferred embodiment of the method according to the invention, a switching operation for switching from the presently executed signal program to the actual signal program to be executed is determined for the characteristic traffic condition during a change. As long as the current traffic condition does not change or changes only slightly during the cyclical detection, the characteristic traffic condition is maintained and the signal program assigned to it therefore remains active. However, if a new characteristic traffic condition results owing to a displacement of the static distribution or, if the characteristic traffic condition of another class suggests itself because of a change in the current traffic condition, then a new signal program must be executed following the cycle change.

A continuous phase transition is determined and executed between the alternating signal programs, so that no traffic endangering signal states occur during the switching operation.

According to a different, preferred embodiment of the invention, traffic data from the intersection are constantly detected with detectors in the form of basic measuring values. The detected basic measuring values are cyclical polled and are processed through averaging or smoothing, wherein replacement values are used for missing measuring values. The actual traffic condition is then derived from the processed and, if necessary, replaced measuring values. In this way, useful and usable measuring values are obtained from the basic measuring values, detected continuously by the detectors, which cyclically provide the method with a current traffic condition at the intersection to be controlled, even in case of a possible malfunction of the detectors.

The system according to the invention for controlling light-signal transmitters at an intersection also comprises a control device for realizing this method.

BRIEF DESCRIPTION OF THE DRAWINGS

With respect to advantages and additional embodiments of the control device, system and method according to the invention, reference is made to the following exemplary description, including the drawings, in which flow charts show schematically.

DETAILED DESCRIPTION OF THE PREFERRED EMBODIMENTS

Traffic control devices that are known per se are typically installed in a switchboard, wherein the individual components such as power supply, control, signal safety, input/ output modules and lamp switch are mounted on a U-shaped frame. The control components include a main processor that controls, for example, up to 48 signal groups, as well as storage modules and diverse interfaces.

Figure 1:
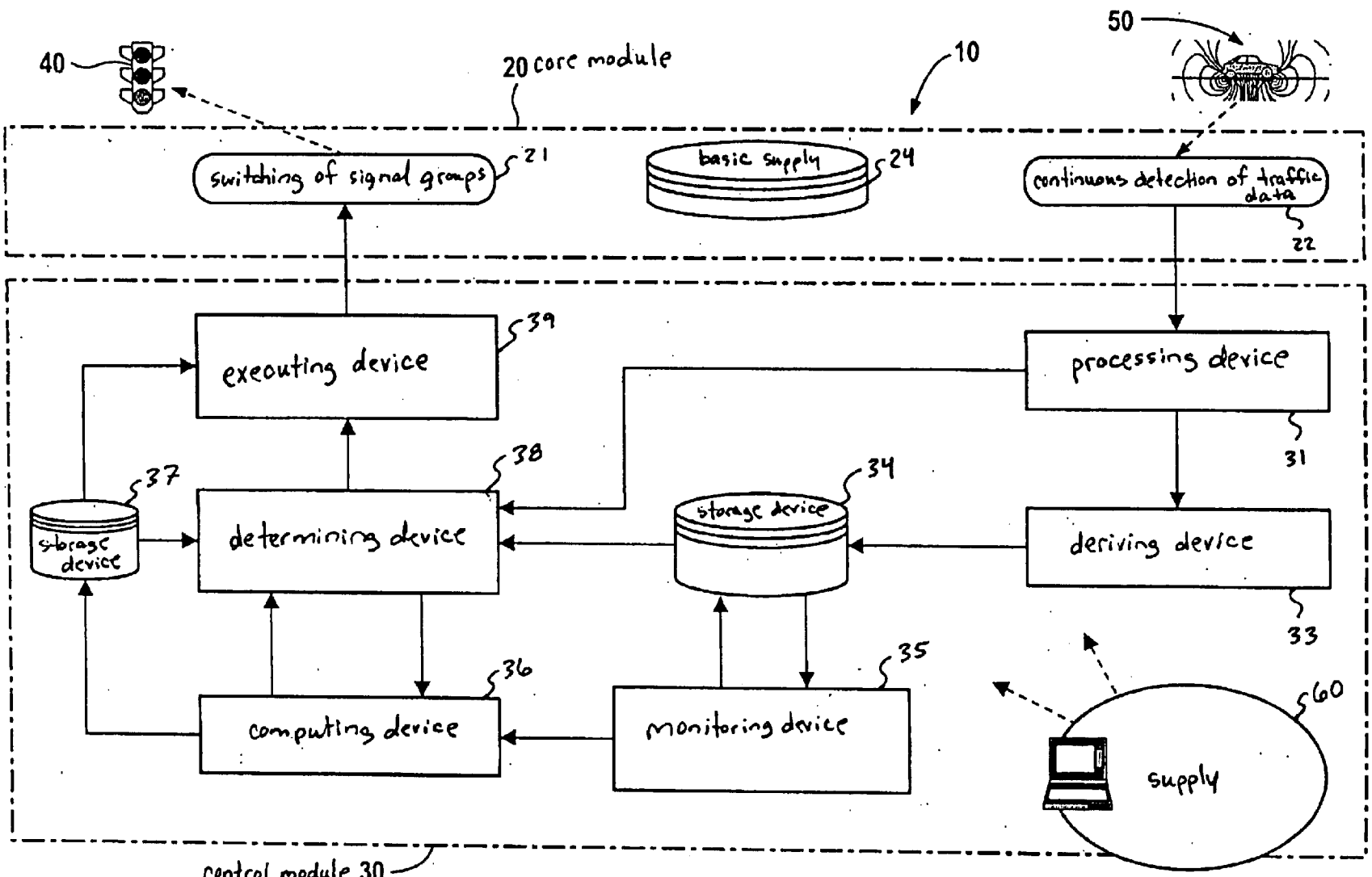
FIG. 1: the modules and elements of a control device according to an embodiment of the invention

A control device 10 according to FIG. 1 includes a core module 20 and a control module 30. The switching 21 of signal groups with light-signal transmitters 40, as well as the continuous detection 22 of traffic data with detectors 50 is realized in the core module 20. Inter-operational times, minimum release times, offset times and transition times can be specified via the basic supply 24 of the core module 20. The control module 30 is encapsulated and the individual interfaces lead to the traffic-dependent core module 20 of the control device 10. The control component 30 in this case does not use the signal program memory of the core module 20, but administers its own signal programs and only executes the corresponding switching commands.

Figure 2:
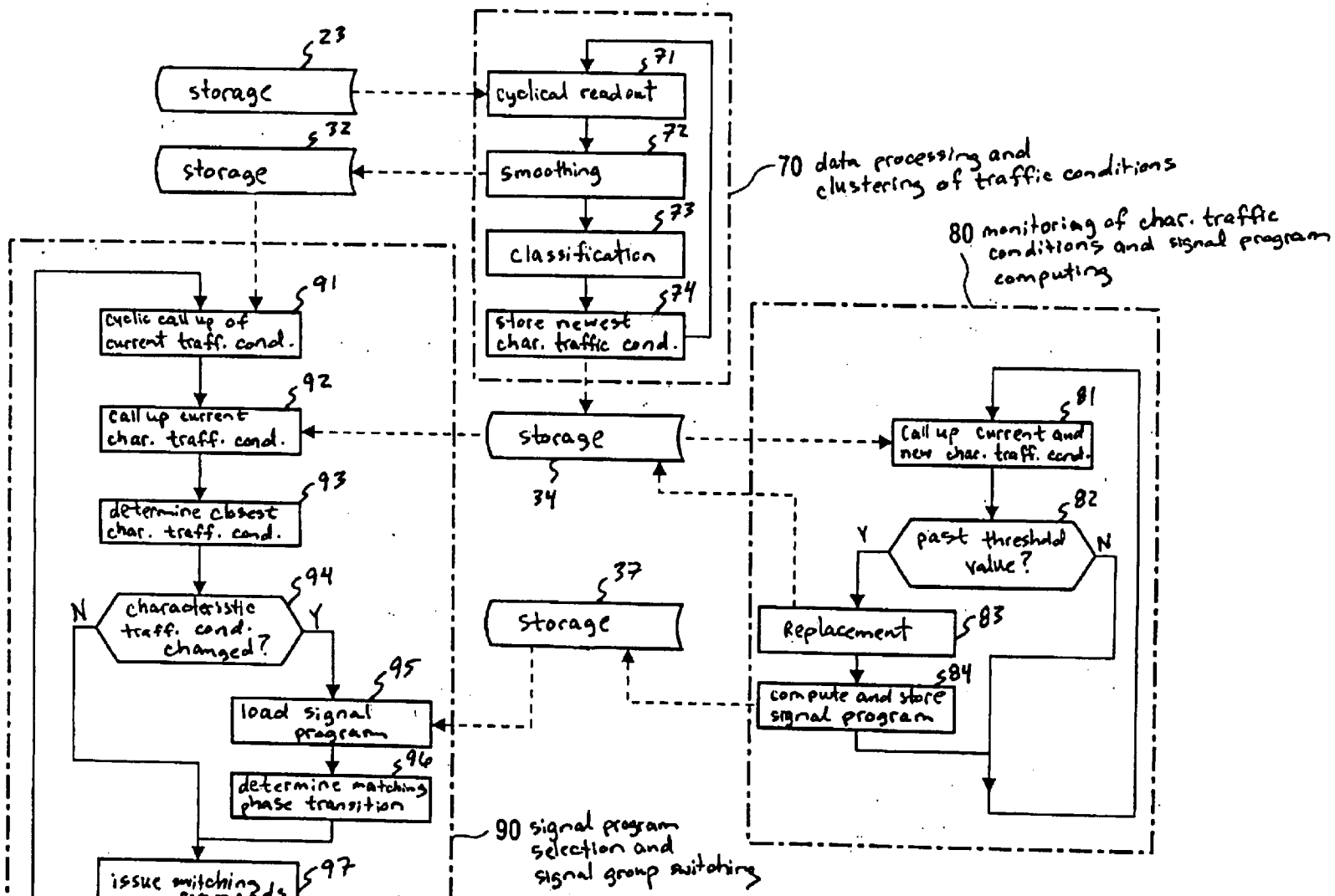
FIG. 2: the partial processes and individual steps of the control method according to an embodiment of the invention.

The control module 30 includes a device 31 for processing the actually detected basic measuring values from the detectors 50. In this data processing unit, the units 23 shown in FIG. 2 are cyclically polled for storing the basic measuring values in the core module 20. The basic measuring values in some circumstances are subsequently compressed by forming an average value or through a special smoothing operation. If different types of measuring values are available, e.g. counting and time gap, derived variables such as LOS values are computed by linking the original values. In case of missing or malfunctioning detectors 50, replacement values are used in place of the original measured values. The replacement measuring values can be optionally defined for the supply 60 of the control module 30. It is also possible to specify replacement values specifically for different day types and hour ranges. The measuring values processed in this way represent the traffic condition detected at the intersection, which is stored in the means 32, shown in FIG. 2, for storing processed measuring values.

The control module 30 further includes a device 33 for deriving characteristic traffic conditions for the intersection. For this, statistics are continuously created for the actual traffic data, wherein special calendar days such as working days, weekends and holidays are taken into consideration. As a result of the use of correspondingly smoothed and/or averaged values, only average to long-term trends are detected via the statistics. Including calendar data is important, so as to be able to react adequately to seldom occurring, but important traffic conditions. With the aid of a cluster method, the complete area of all possible traffic conditions is divided into disjunctive classes based on the statistics. The maximum number of classes can be predetermined via the supply 60 of the control module 30. For each class, a representative value is computed, the so-called characteristic traffic condition. The determination of classes and their representative values is based on metrics, meaning specific distance functions, which are expressions of special capacity criteria such as waiting times or set-up lengths. The type of criteria can be selected in the supply 60 of the control module 30. The characteristic traffic conditions are stored in the device 34.

The control module 30 furthermore comprises a device 35 for monitoring changes in the characteristic traffic conditions. The currently valid characteristic traffic conditions are respectively compared to the newly computed characteristic traffic conditions and it is determined whether the new, drifted if applicable, traffic conditions have moved away in excess of a specific, predetermined measure from the currently valid characteristic traffic conditions. Once a threshold is exceeded, a new, drifted characteristic traffic condition replaces the currently valid representative value for this class. To determine the distance between two characteristic traffic conditions, the same metrics are used as for the clustering of traffic conditions.

The control module 30 further comprises a device 36 for computing signal programs, which are matched to a stored characteristic traffic condition and are assigned to this condition. For each new, drifted characteristic traffic condition, an optimum signal program is computed with the aid of a "genetic algorithm" and on the basis of attributes of a characteristic traffic condition, e.g. counting values or traffic densities, the intersection topology and additional information such as directional priorities, set-up lengths and offset times. The criterion for optimization, meaning the target function, can be specified freely in that case. The maximum number of signal groups for this exemplary embodiment is limited to sixteen. The newly computed signal program is stored in the means 37 for storing signal programs, wherein it is assigned to the characteristic traffic condition to which it is tailored.

The control module 30 comprises a device 38 for determining the characteristic traffic condition with associated signal program that is closest to the actual traffic condition. In dependence on the traffic conditions detected online, the respectively matching signal program is selected by determining the closest characteristic traffic condition. For a distance determination, the same metrics are used as for the analysis and clustering of the traffic conditions. A free emergency signal program is available to react quickly to extreme, unusual situations. This program can be overwritten and switched quickly depending on the situation and, in particular, is not subject to the drift of the characteristic traffic conditions. In case of a signal program change, the respective phase transitions are determined, which take into account the standard frame conditions such as intermediate and offset times. Existing routines in the core module 20 are used for computing the phase transitions.

Finally, the control module 30 includes a device 39 for executing a signal program. Corresponding to the presently active signal program, switching commands for the light-signal transmitters 40 are transmitted every second to the core module 20 of the control device 10. As a result, the control module 30 has its own fixed-time control with automatically administered signal programs.

The method for controlling light-signal transmitters 40 at an intersection according to FIG. 2 includes three cyclical partial processes "data processing and clustering of traffic conditions" 70, "monitoring of the characteristic traffic conditions and signal program computing" 80 and "signal program selection and signal group switching" 90. These partial processes use the in part joint local device 23 for storing basic measuring values from the detectors 50, the device 32 for storing processed measuring values and/or traffic conditions, the device 34 for storing characteristic traffic conditions as well as the device 37 for storing the signal programs assigned to the characteristic traffic conditions. Otherwise, the partial processes, however, operate independent of each other.

The partial process 70 starts at step 71 with the cyclical readout of the basic measuring values from the memory 23. In step 72, these basic measuring values are combined, meaning they are smoothed and if necessary averaged as to time, and linked. In case of malfunctioning or missing detectors 50, replacement values can be used. The measuring values processed in this way form the traffic conditions with which the method operates and are stored in the memory 32. In step 73, the area for the traffic conditions is divided into a fixed number of classes, corresponding to a statistical distribution of the traffic conditions. For each class, a representative value is computed, a so-called characteristic traffic condition. In step 74, the respectively newest characteristic traffic conditions are stored in the memory 34 where they are overwritten cyclically if necessary. The memory 34 also contains the presently valid characteristic traffic conditions based on which the automatic signal program selection actually operates.

The partial process 80 starts in step 81, with the calling up of the currently valid and the newly computed characteristic traffic conditions from the memory 34. In step 82, it is cyclically checked whether a newly computed characteristic traffic condition has moved past a threshold value away from the currently valid characteristic traffic condition. When determining the mutual position of the characteristic traffic conditions, a predetermined metrics is used as measure for the distance. When the threshold value is exceeded, the presently valid characteristic traffic condition is replaced in step 83 with the newly computed, drifted characteristic traffic condition and is stored in the memory 34. Furthermore, in step 84 a signal program tailored to the new characteristic traffic condition is computed, is assigned to it and is stored in the memory 37.

The partial process 90 starts in step 91 with a cyclical calling up of the current traffic condition from the memory 32. In the further step 92, the currently valid characteristic traffic condition is called up from the memory 34 and in step 93 it is determined which of the valid characteristic traffic conditions is closest to the actual traffic condition with respect to a predetermined metrics. In step 94, a decision is made on whether the characteristic traffic condition has changed—either through a drift inside the same class or a class change—based on the actual traffic condition. If that is the case, an associated signal program is loaded in step 95 from the memory 37 and in step 96, a matching phase transition is determined for switching the presently active to the newly loaded signal program. Finally, in step 97, switching commands for the signal groups containing light-signal transmitters 40 are issued corresponding to the actual signal plan or based on the specific phase transition. The collection of stored signal programs constantly adapts to the current statistical distribution of the traffic values, thus causing the control device 10 according to n embodiment of the invention to self-organize.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for controlling light-signal transmitters at an intersection, comprising:

detecting a traffic condition at the intersection cyclically;

deriving characteristic traffic conditions for the intersection from the detected traffic conditions;

for each of the characteristic traffic conditions, selecting a signal program matched to the characteristic traffic condition and assigning the signal program to the characteristic traffic condition;

defining a metric as a measure of the relative positions of two traffic conditions;

determining the characteristic traffic condition that is closest to the actual traffic condition with respect to the defined metric; and executing the signal program that is assigned to the closest characteristic traffic condition, wherein switching commands for the light-signal transmitters are issued.

2. A method according to claim 1, wherein a statistical distribution of all detected traffic conditions is formed after each detection of the actual traffic condition;

the traffic conditions are combined to form classes that correspond to the statistical distribution; and a characteristic traffic condition is determined as representative for each class of traffic conditions.

3. A method according to claim 1, wherein the distance between a newly determined characteristic traffic condition of one class of traffic conditions and the actually valid characteristic traffic condition of said class is determined;

if a predetermined threshold value is exceeded for the distance, the actually valid characteristic traffic condition is replaced with the newly determined characteristic traffic condition for this class; and a signal program that is assigned to the newly determined characteristic traffic condition is computed.

4. A method according to claim 1, wherein a switching operation from the presently executed signal program to the current signal program that must be executed is determined during a change in the characteristic traffic condition.

5. A method according to claim 1, wherein traffic data at the intersection are continuously detected in the form of basic measuring values by detectors;

the detected basic measuring values are cyclically polled and are processed either through averaging or smoothing;

replacement values are used in case of missing measuring values;

the actual traffic condition is derived from the processed and, if necessary, replaced measuring values.

6. A control device for controlling light-signal transmitters at an intersection comprising:

means for storing traffic conditions detected at an intersection cyclically;

means for deriving characteristic traffic conditions for the intersection from the stored traffic conditions;

means for storing the derived characteristic traffic conditions;

means for computing signal programs which are respectively matched to a stored characteristic traffic condition and are assigned to this traffic condition;

means for storing signal programs that are assigned to the characteristic traffic conditions;

means for defining a metric as a measure of the relative positions of two traffic conditions;

means for determining the characteristic traffic condition that is closest to an actual traffic condition with respect to the defined metric; and means for executing a signal program that is assigned to the closest characteristic traffic condition, and for issuing switching commands to the light-signal transmitters.

7. A control device according to claim 6, wherein the means for deriving the characteristic traffic conditions for the intersection are designed to select, means for forming a statistical distribution of the detected traffic conditions, means for combining the traffic conditions into classes, corresponding to the statistical distribution, and means for determining a characteristic traffic condition as representative for a class of traffic conditions.

8. A control device according to claim 6, further comprising:

means for monitoring the position of two characteristic traffic conditions relative to each other, wherein the distance between the two characteristic traffic conditions is compared to a predetermined threshold value.

9. A control device according to claim 6, further comprising:

means for processing the basic measuring values actually detected by the detector, wherein the processed measuring values represent the traffic condition detected at the intersection.

10. A method according to claim 2, wherein the distance between a newly determined characteristic traffic condition of one class of traffic conditions and the actually valid characteristic traffic condition of said class is determined;

if a predetermined threshold value is exceeded for the distance, the actually valid characteristic traffic condition is replaced with the newly determined characteristic traffic condition for this class; and a signal program that is assigned to the newly determined characteristic traffic condition is computed.

11. A method according to claim 2, wherein a switching operation from the presently executed signal program to the current signal program that must be executed is determined during a change in the characteristic traffic condition.

12. A method according to claim 2, wherein traffic data at the intersection are continuously detected in the form of basic measuring values by detectors;

the detected basic measuring values are cyclically polled and are processed either through averaging or smoothing;

replacement values are used in case of missing measuring values;

the actual traffic condition is derived from the processed and, if necessary, replaced measuring values.

13. A method according to claim 3, wherein a switching operation from the presently executed signal program to the current signal program that must be executed is determined during a change in the characteristic traffic condition.

14. A method according to claim 3, wherein traffic data at the intersection are continuously detected in the form of basic measuring values by detectors;

the detected basic measuring values are cyclically polled and are processed either through averaging or smoothing;

replacement values are used in case of missing measuring values;

the actual traffic condition is derived from the processed and, if necessary, replaced measuring values.

15. A method according to claim 4, wherein traffic data at the intersection are continuously detected in the form of basic measuring values by detectors;

the detected basic measuring values are cyclically polled and are processed either through averaging or smoothing;

replacement values are used in case of missing measuring values;

the actual traffic condition is derived from the processed and, if necessary, replaced measuring values.

16. A control device according to claim 7, further comprising:

means for monitoring the position of two characteristic traffic conditions relative to each other, wherein the distance between the two characteristic traffic conditions is compared to a predetermined threshold value.

17. A control device according to claim 7, further comprising:

means for processing the basic measuring values actually detected by the detector, wherein the processed measuring values represent the traffic condition detected at the intersection.

18. A control device according to claim 8, further comprising:

means for processing the basic measuring values actually detected by the detector, wherein the processed measuring values represent the traffic condition detected at the intersection.

19. A system for controlling light-signal transmitters at an intersection comprising the control device of claim 6.

20. A system for controlling light-signal transmitters at an intersection comprising the control device of claim 7.

21. A system for controlling light-signal transmitters at an intersection comprising the control device of claim 8.

22. A system for controlling light-signal transmitters at an intersection comprising the control device of claim 9.

* * * * *